US005730554A

United States Patent [19]

Mosley et al.

[11] Patent Number: 5,730,554

[45] Date of Patent: Mar. 24, 1998

[54] ARTICULATED RISER PROTECTOR

[75] Inventors: Andrew S. Mosley, Oyne; James A. K. Edgar, Insch; Adrian M. Peers, Tarves, all of Great Britain

[73] Assignee: ABB Vetco Gray Inc., Houston, Tex.

[21] Appl. No.: 620,432

[22] Filed: Mar. 22, 1996

[51] Int. Cl.[6] ..... E02B 17/00; E21B 17/12

[52] U.S. Cl. ..... 405/195.1; 166/350; 166/359; 405/224

[58] Field of Search ..... 405/224, 202, 405/203, 204, 205, 207, 208, 206, 195.1; 166/350, 359, 367

[56] References Cited

U.S. PATENT DOCUMENTS

| | | | |
|---|---|---|---|
| 3,330,340 | 7/1967 | Hayes et al. | 166/350 X |
| 3,948,291 | 4/1976 | Persson . | |
| 4,363,567 | 12/1982 | Van Der Graaf | 405/195.1 |
| 4,383,554 | 5/1983 | Merriman | 166/350 X |
| 4,470,722 | 9/1984 | Gregory | 405/195.1 |
| 4,646,840 | 3/1987 | Bartholomew et al. | 405/171 X |
| 4,648,747 | 3/1987 | Watkins et al. | 405/195.1 |
| 4,695,193 | 9/1987 | Sebastiani et al. | 405/202 X |
| 4,793,739 | 12/1988 | Hasle et al. | 405/202 X |
| 4,854,781 | 8/1989 | Sparks et al. | 405/202 X |
| 4,892,444 | 1/1990 | Moore . | |
| 5,330,294 | 7/1994 | Guesnon | 405/224.2 |
| 5,439,323 | 8/1995 | Nance | 405/195.1 |

OTHER PUBLICATIONS

Technology Update Bulletin, Value Through Technology by Vetco Gray, p. 13, entitled Component Standardization for Tree Installation, Workover Systems Reduces Operating Costs by Robert K. Voss, Jr., Engineering Manager.

*Primary Examiner*—Dennis L. Taylor
*Attorney, Agent, or Firm*—James E. Bradley

[57] ABSTRACT

A protective sleeve protects a riser that extends between a subsea wellhead and a floating vessel. The protective sleeve has less resistance to bending than the riser so as to allow the riser to bend normally due to normal movement of the vessel. The stiffness of the protective sleeve augments the stiffness of the riser only if the acceptable level of bending is exceeded. The protective sleeve is made up of at least three segments that are articulated together to facilitate bending.

12 Claims, 3 Drawing Sheets

ARTICULATED RISER PROTECTOR

BACKGROUND OF THE INVENTION

1. Field of the invention

This invention relates in general to offshore drilling and production technology and in particular to a riser protector for a dual bore completion riser.

2. Description of the Prior Art

In one type of offshore drilling, a floating drilling vessel will be positioned above a subsea well that has been cased and drilled in order to install a production tree. The tree is lowered from the vessel and installed on a subsea wellhead at the sea floor. The tree will be run with a tree running tool which is secured to a dual bore completion riser. The riser comprises two strings of tubing spaced side-by-side. One string of tubing is larger in diameter and serves as the conduit for production fluid, while the other communicates with the annulus.

The upper end of the riser will extend through the rotary table of the drilling rig. The operator connects a terminal head on the upper end of the riser to equipment for testing the well. Subsequently, the riser will be removed and production flowlines connected to the subsea tree. While testing, the vessel will be moving due to wind, wave and current. Portions of the riser will contact the edges of the opening in the rotary table as the vessel moves laterally relative to the wellhead, causing bending of the riser.

To avoid damage to the riser where it contacts the rotary table, wear bushings or protective shrouds have been used in the past. The prior art protective shroud is a cylindrical rigid member which encloses the riser in the vicinity of the rotary table. One disadvantage of the prior art type is that the protective shroud is stiff and will not bend due to vessel movement. This stiffness pushes bending loads up and down adjacent unprotected portions of the riser, causing overstressing.

SUMMARY OF THE INVENTION

In this invention, an articulated wearbushing or protective sleeve is utilized. The sleeve assembly is capable of laterally flexing or bending along its length. It will be located in the riser string in the vicinity of the rotary table. The resistance of the sleeve to bending is less than the resistance of the riser to bending. Consequently, it will not prevent bending of the riser within its limits. If acceptable limits are exceeded, the riser protector will provide additional stiffness to prevent overstressing of the riser.

In the preferred embodiment, the sleeve assembly comprises at least three modules or sections mounted to the pipe. Each section is a cylindrical member separated from the other sections by an axial gap. The axial gap allows flexing. A pair of conduits pass through holes in transverse standoff plates in each section. Each conduit is connected to one of the strings of tubing and is the same diameter and thickness as the tubing. The holes for one of the conduits are larger in diameter than the outer diameter of the conduit, providing radial clearances. The radial clearances allow a certain amount of bending of the conduit without contact with the edges of the holes. If the bending exceeds the desired limit, the conduit within the protective sleeve will engage the edges of the holes, transferring bending forces to the separate modules. Once the conduit contacts the edges of the holes, the stiffness of each individual module augments the resistance to bending of the conduit.

DETAILED DESCRIPTION OF THE INVENTION

Figure 1:
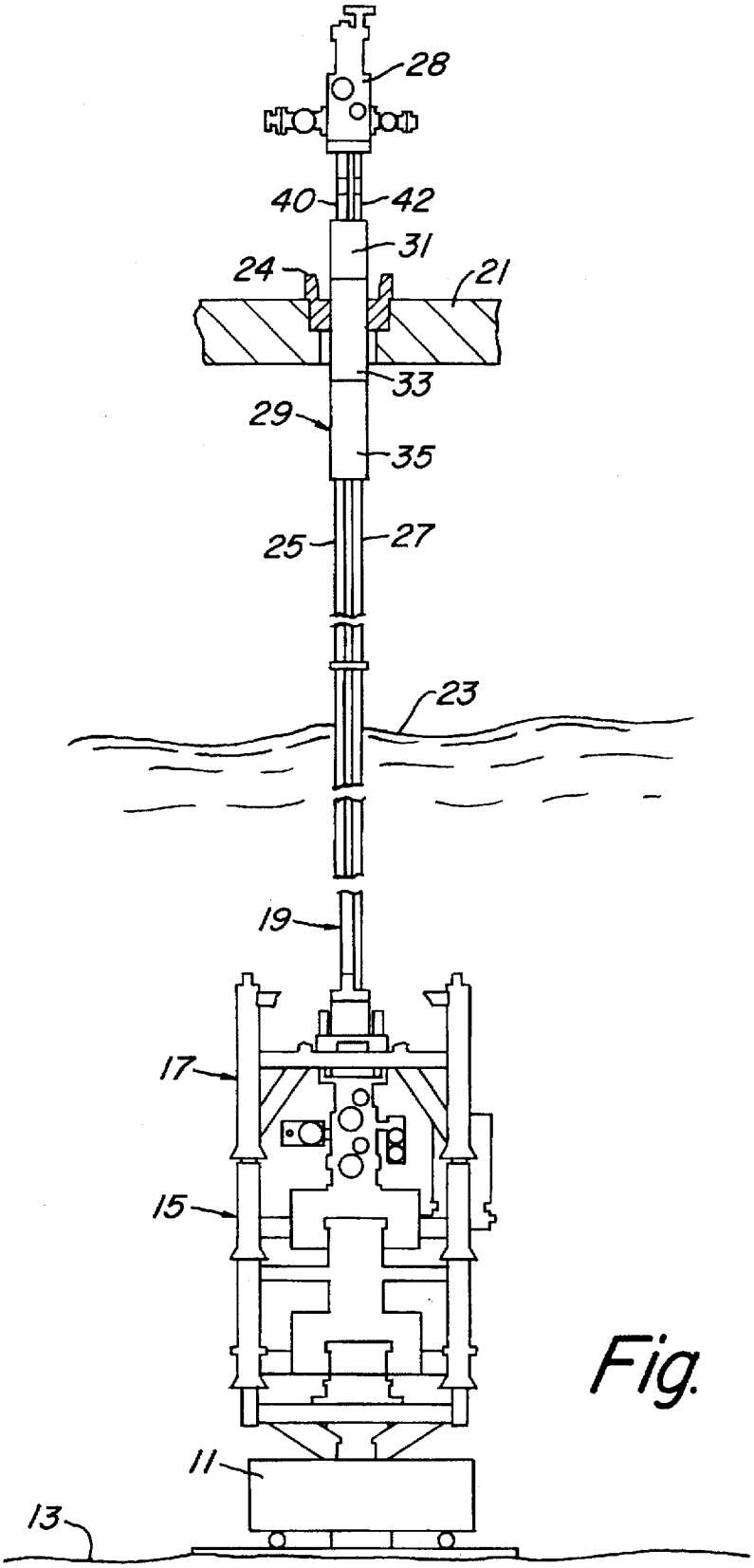
FIG. 1 is a schematic view illustrating a riser installing a subsea tree and having a riser protector constructed in accordance with this invention.

Referring to FIG. 1, a subsea wellhead 11 is schematically shown located at a sea floor 13. A production tree 15 is shown being installed on wellhead 11. Tree 15 is being run with a tree running tool 17 located at the lower end of a dual bore completion riser 19. Riser 19 extends upward above sea level 23 and through a rotary table 21 of a drilling vessel. Once tree 15 is connected to wellhead 11, a riser spider 24 will support riser 19 in rotary table 21.

Riser 19 includes two strings of tubing 25, 27 which are spaced side-by-side. Tubing 25 is larger in diameter than tubing 27 and will be used for production fluids. Tubing 27 is for communication with the well annulus. A terminal head 28 is connected to the upper end of riser 19. Terminal head 28 is connected to other equipment on the vessel for testing the well once tree 15 is installed.

A wear bushing or protective sleeve 29 is mounted to riser 19 in the vicinity of rotary table 21. Protective sleeve 29 extends through rotary table 21 to prevent damage to riser 19 in the vicinity of rotary table 21. Protective sleeve 29 has a lower resistance to bending than riser 19, so that riser 19 can bend up to acceptable limits without being impeded by protective sleeve 29. The portion of riser 19 below protective sleeve 29 is thus allowed to bend within a selected tolerance with no additional bending stiffness than as if protective sleeve 29 were eliminated.

Figure 2A:
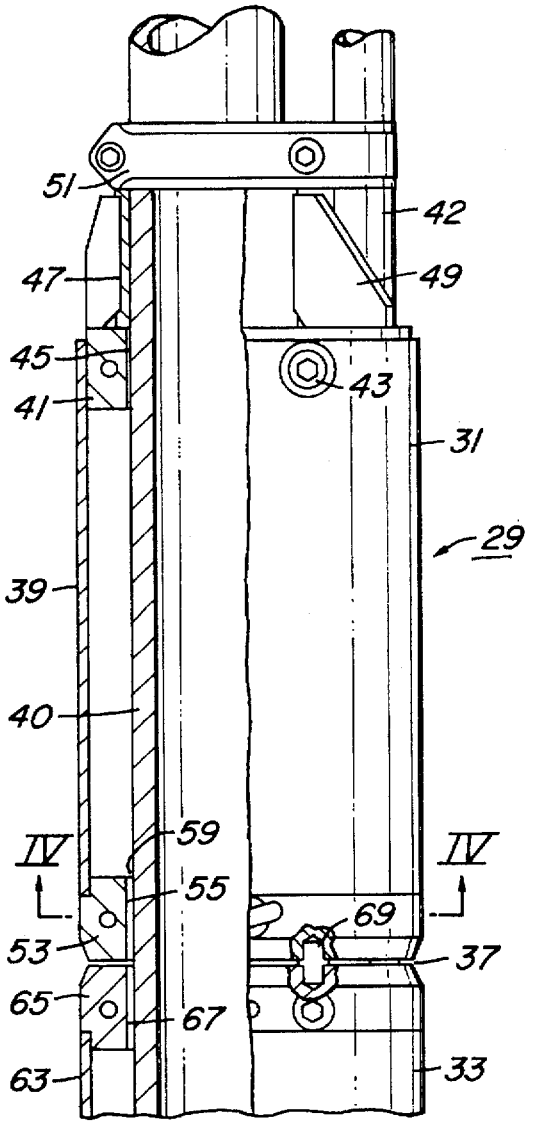
FIGS. 2A and 2B comprise a partial vertical sectional view of the riser protector of FIG. 1.
Figure 2B:
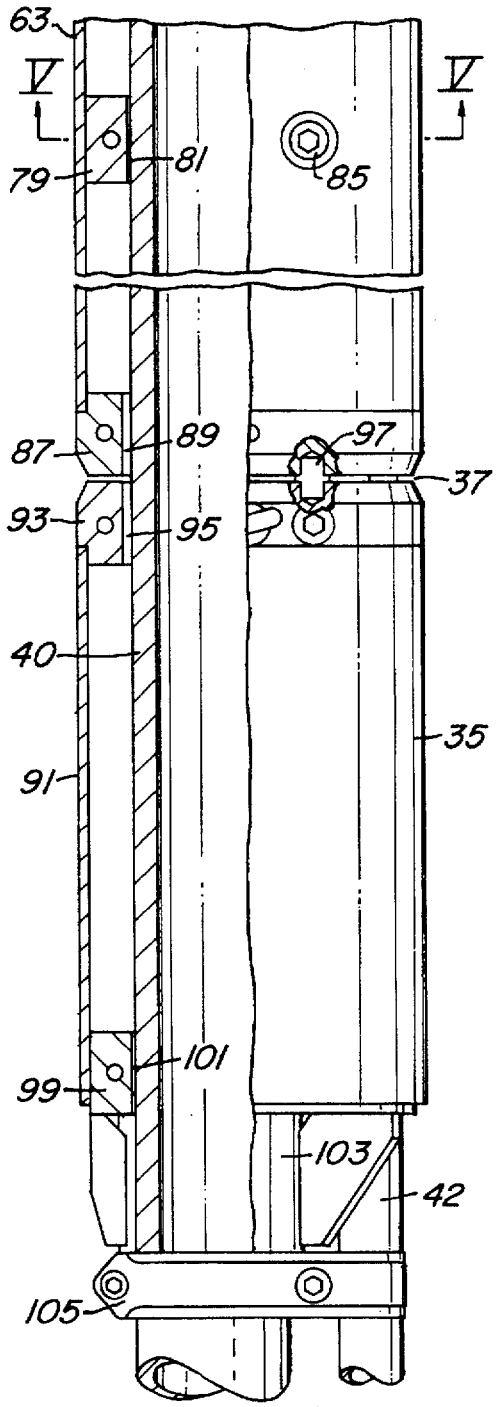

Referring to FIGS. 2A, 2B, protective sleeve 29 includes an upper segment 31, and at least one intermediate segment 33 and a lower segment 35. Segments 31, 33, 35 are cylindrical members that are separated from each other by axial gaps 37. The mounting means for these segments 31, 33, 35 allows articulation of the segments relative to each other. Upper segment 31 includes an upper metal cylindrical housing 39. Housing 39 is a solid cylinder that surrounds two conduits 40, 42. Conduit 40 is the same size and thickness as production tubing 25 and has the same resistance to bending. Conduit 42 is the same size and thickness as annulus tubing 27 and has the same resistance to bending. Conduits 40, 42 may be considered to be part of the tubing strings 25, 27 of riser 19 because they are connected to and the same sizes as tubing strings 25, 27. Preferably, conduits 40, 42 are assembled as a part of segments 31, 33, 35 at a manufacturing facility.

An upper standoff plate 41 is mounted at the upper end of housing 39. Upper standoff plate 41 comprises two halves secured by bolts 43. The combined halves create a flat disk that is perpendicular to the axis of upper housing 39. Upper standoff plate 41 has two holes 45 for receiving conduits 40, 42. One of the holes 45 accepts conduit 40, while the other accepts conduit 42. The diameters of holes 45 are selected to be same as the outer diameters of conduits 40, 42.

Figure 3:
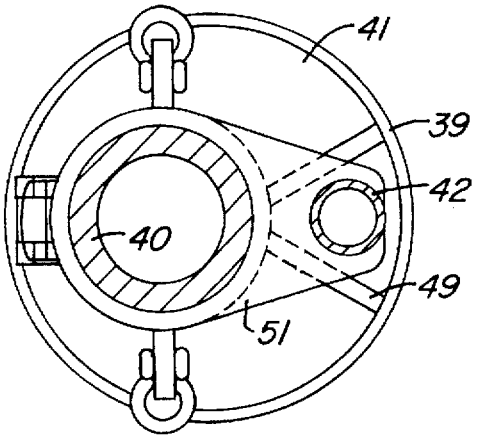
FIG. 3 is a top plan view of the riser protector of FIGS. 2A and 2B.

Conduit 40 extends through a collar 47 which protrudes upward from upper standoff plate 41. Gussets 49 connect collar 47 to upper standoff plate 41. Conduit 42 extends upward from upper standoff plate 41, also. A clamp 51 mounts above collar 47. Clamp 51 comprises two halves that bolt together, as shown in FIG. 3, to grip conduits 40, 42. Clamp 51 will support the weight of upper segment 31 on conduits 40, 42.

Figure 4:
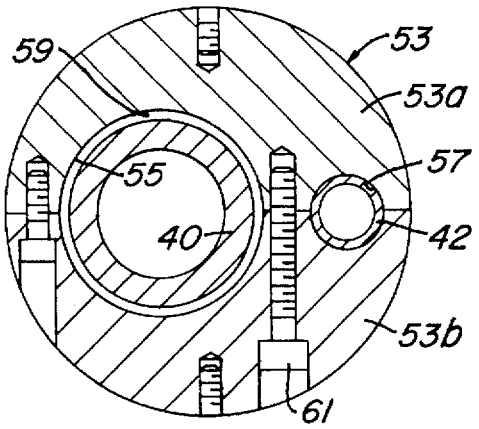
FIG. 4 is a sectional view of the riser protector of FIGS. 2A and 2B, taken along the line IV—IV of FIG. 2A.

Referring still to FIG. 2A, upper segment 31 has a lower standoff plate 53 located at its lower end. Lower standoff plate 53 is of two halves 53*a*, 53*b*, as shown in FIG. 4. Lower standoff plate 53 has two holes 55, 57 for receiving conduits 40, 42, respectively. Hole 55 is larger in diameter than the outer diameter of conduit 40, resulting in a radial clearance or gap 59. In one embodiment, gap 59 is about ½ inch on a side. On the other hand, hole 57 has the same outer diameter as the smaller diameter conduit 42. Bolt 61 bolts the two halves 53*a*, 53*b* of lower standoff plate 53.

Several intermediate segments 33 may be employed, although only one is shown. Intermediate segment 33 has a solid cylindrical housing 63. An upper standoff plate 65 is located at the upper end of intermediate housing 63. Upper standoff plate 65 is identical to lower standoff plate 53 of upper segment 31. It is in two halves bolted together. It has a hole 67 for each of the conduits 40, 42. The hole 67 for the larger conduit 40 is greater in diameter than the outer diameter of conduit 40, creating a radial clearance or gap that is the same as gap 59.

Figure 6:
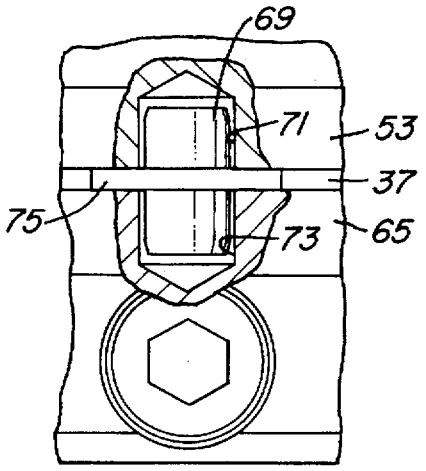
FIG. 6 is an enlarged partial sectional view of a spacer utilized with the riser protector of FIGS. 2A and 2B.

Axial gap 37 between upper segment 31 and intermediate segment 33 is provided by spacers 69 (only one shown). Preferably two of the spacers 69 are located between standoff plates 53, 65. Spacers 69 are pins, shown in FIG. 6, that insert within mating holes 71, 73 in the adjacent standoff plates 53, 65. Each spacer pin 69 has an integral circular rib 75 that is of greater diameter than the holes 71, 73. Rib 75 has a thickness sized to provide the desired axial gap 37, which is about ¼ inch.

Figure 5:
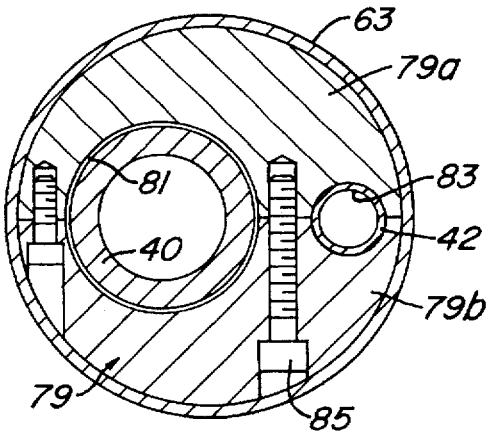
FIG. 5 is a sectional view of the riser protector of FIGS. 2A and 2B, taken along the line V—V of FIG. 2B.

In the preferred embodiment, intermediate segment 33 also contains a central standoff plate 79 located within intermediate housing 63 approximately halfway along its length. Intermediate standoff plate 79 has an outer diameter that will locate within the inner diameter of intermediate housing 63. Intermediate standoff plate 79, as shown in FIG. 5, has two halves 79*a*, 79*b* bolted together and to intermediate housing 63 by bolts 85. As shown in FIG. 5, intermediate standoff plate 79 has two holes 81, 83 for receiving conduits 40, 42. The diameters of the holes 81, 83 equal the outer diameters of conduits 40, 42 so as to frictionally grip conduits 40, 42 when bolts 85 are installed.

A lower standoff plate 87 is located at the lower end of intermediate housing 63. Lower standoff plate 87 is identical to lower standoff plate 53 of upper segment 31. Lower standoff plate 87 has holes 89 for receiving conduits 40, 42. The hole 89 for the larger diameter conduit 40 is sized to provide a radial gap that is the same as gap 59 (FIG. 2A).

Lower segment 35 has a lower housing 91 that is a metal cylinder having the same diameter as housings 39 and 63. An upper standoff plate 93 is located at the upper end of lower housing 91. Upper standoff plate 93 is identical to upper standoff plate 65 of intermediate segment 33. Upper standoff plate 93 has a hole 95 through it for each conduit 40, 42. The diameter of hole 95 for the larger diameter conduit 40 is larger than the outer diameter of conduit 40, creating a radial gap that is the same as gap 59. Axial gap 37 is provided by spacer pins 97 (only one shown). Spacer pins 97 are the same as spacer pins 69 and are installed in the same manner.

A lower standoff plate 99 is located at the lower end of lower housing 91. Lower standoff plate 99 is the same as upper standoff plate 41 (FIG. 2A). It has holes 101 for the passage of conduits 40, 42. The hole 101 for the larger diameter conduit 40 is the same as the outer diameter of conduit 40 so that it will frictionally grip it when the two halves of lower standoff plate 99 are joined. Conduit 40 passes through a collar 103 which extends downward from lower standoff plate 99. A clamp 105 clamps conduits 40, 42 to lower housing 91.

Protective sleeve 29 will preferably be fabricated and installed on the upper end of riser 19 as a unit. The production conduit 25 in riser 19 will be secured by threads to the lower end of conduit 40. The lower end of conduit 42 will telescopingly stab without rotation into the upper end of annulus tubing 27. Terminal head 28 (FIG. 1) will be installed on the upper ends of the conduits 40, 42.

The lower portion protective sleeve 29 will extend below rotary table 21 and the upper portion of protective sleeve 29 will extend above rotary table 21. If the vessel moves laterally because of waves, wind or current, some bending of riser 19 occurs. Protective sleeve 29 will be contacted by an edge of rotary table 21. Protective sleeve 29 will bend freely up to a selected degree because of axial gaps 37 and radial gaps 59. Gaps 37, 59 allow conduit 40 to bend as if protective sleeve 29 were not present because they provide sleeve 29 with articulation, resulting in a lesser resistance to bending than conduit 40. Although there are no radial gaps surrounding annulus conduit 42, its bending is not adversely affected because its axial stab connection with riser 19 allows telescoping movement during bending.

During the bending, spacer pins 69, 97 allow some cocking or angular movement of the mating standoff plates 53, 65 and 87, 93 relative to each other. Axial gaps 37 may close slightly on an inner portion of the bend and open slightly on an outer portion of the bend. This creates an articulation of the segments 31, 33 and 35 relative to each other.

During bending, if within acceptable limits, the radial gaps 59 will not close against conduit 40. This allows a gradual bend to occur in conduit 40 from the upper end of protective sleeve 29 to the lower end without interference from the housings 39, 63 and 91. In the event that the bending becomes too severe, gaps 59 would close against conduit 40. For example, during excessive bending, the edge of hole 55 of lower standoff plate 53 would contact conduit 40 at two points 180 degrees from each other. The two point contact occurs only if the angular bend exceeds the selected limited. Once the two point contact is made, the stiffness of housing 39 will be added to the stiffness of the conduit 40 between lower standoff plate 53 and upper standoff plate 41. For any additional bending to occur, housing 39 must also bend. This creates additional stiffness to avoid exceeding the yield strength of conduit 40 in that area. Gaps 59 are sized so that the acceptable limit of bending is safely before the yield strength of the conduit 40 is reached, preferably about ⅔ of the yield strength. This yield strength is the same as the yield strength of production tubing 25.

A similar event occurs in the intermediate segment 33 and lower segment 35. Excessive angular bending of conduit 40 will cause it to be contacted on two points, 180 degrees apart from each other, at the holes 67, 89 and 95. This applies a bending force to intermediate housing 53 and to lower housing 91 to provide additional stiffness to withstand excessive bending. No bending forces will be applied to housings 39, 63 and 91 unless the acceptable limits of bending are exceeded.

The invention has significant advantages. The protective sleeve prevents chaffing and wear on the dual completion riser. It allows bending of the riser in the vicinity of the rotary table without adding any additional stiffness. It provides bending protection by adding additional stiffness if the amount of bending exceeds an acceptable limit.

While the invention has been shown in only one of its form, it should be apparent to those skilled in the art that it is not so limited but is susceptible to various changes without be departing from the spirit of the invention.

We claim:

1. An apparatus for operations on a subsea well, comprising in combination:

a floating vessel having an opening;

a subsea wellhead at a sea floor;

a riser connected to the wellhead and extending through the opening in the surface vessel; and a protective sleeve assembly mounted to the riser where it passes through the opening for protecting the riser due to movement of the vessel, the protective sleeve assembly extending downward and terminating at a lower end a short distance below the vessel; and the sleeve assembly having a plurality of segments which are loosely connected to one another to allow limited angular movement relative to each other so as to not impede bending of the riser up to a selected maximum.

2. The apparatus according to claim 1 wherein each of the segments has a cylindrical exterior and is spaced from the other segments by a selected axial gap to allow articulated movement relative to one another during bending of the riser.

3. An apparatus for communicating fluids between a subsea wellhead and a surface vessel, comprising:

a riser adapted to be connected to the wellhead and extend to the surface vessel;

a protective sleeve assembly mounted to and surrounding the riser for protecting the riser during bending of the riser due to movement of the vessel; and wherein the riser comprises at least one string of tubing and the sleeve assembly comprises a plurality of segments, each of the segments comprising:

a conduit connected to the string of tubing;

a metal cylindrical housing surrounding and spaced radially from the conduit;

an upper standoff secured to the upper end of the housing and having a hole through which the conduit passes; and a lower standoff secured to the lower end of the housing and having a hole through which the conduit passes, at least one of the holes having a diameter greater than an outer diameter of the conduit by a radial gap to facilitate bending of the conduit.

4. An apparatus for communicating fluids between a subsea wellhead and a surface vessel, comprising in combination:

a riser adapted to be connected to the wellhead and extend to the surface vessel; and a protective sleeve assembly mounted to and surrounding the riser for protecting the riser during bending of the riser due to movement of the vessel;

wherein the riser comprises at least one string of tubing and the sleeve assembly comprises:

a conduit connected to the string of tubing;

an upper segment having a cylindrical housing surrounding and spaced radially from the conduit, the upper segment having an upper standoff plate secured to the conduit, the upper segment having a lower standoff plate having a hole through which the conduit passes, the hole being larger in diameter than an outer diameter of the conduit to provide a selected radial gap;

an intermediate segment having a cylindrical housing surrounding and spaced radially from the conduit below the upper segment, the intermediate segment having an upper standoff plate and a lower standoff plate, each of the upper and lower standoff plates of the intermediate segment having a hole through which the conduit passes and which is larger in diameter than the conduit to provide a selected radial gap;

a lower segment having a cylindrical housing surrounding and spaced radially from the conduit below the intermediate segment, the lower segment having an upper standoff plate having a hole through which the conduit passes and which is larger in diameter than the conduit to provide a selected radial gap, the lower segment having a lower standoff plate secured to the conduit; and spacer means between the intermediate segment and the upper and lower segments for providing selected axial gaps between the segments to allow articulated movement of the segments relative to one another.

5. A protective sleeve for mounting to a riser connected to a subsea wellhead and extending to a surface vessel to prevent damage to the riser due to movement of the vessel, comprising:

a conduit adapted to be connected to the riser;

a plurality of protective segments, each of the segments having a cylindrical exterior surrounding the conduit; and mounting means for mounting each of the segments to the conduit and to each other for articulated movement relative to one another and to the conduit so as to avoid impeding normal bending of the conduit due to movement of the vessel.

6. The protective sleeve according to claim 5 wherein the segments comprise an upper and a lower segment and wherein the mounting means comprises:

an upper fastener on an upper end of the upper segment connecting the upper segment to the conduit;

the upper segment having a lower end which is free of connection with and radially movable relative to the conduit;

a lower fastener on a lower end of the lower segment connecting the lower segment to the conduit; and the lower segment having an upper end which is free of connection with and radially movable relative to the conduit.

7. A protective sleeve for mounting to a riser connected to a subsea wellhead and extending to a surface vessel to prevent damage to the riser due to movement of the vessel, comprising:

a conduit adapted to be connected to the riser;

a plurality of protective segments, each of the segments having a cylindrical exterior surrounding the conduit; and mounting means for mounting each of the segments to the conduit and to each other for articulated movement relative to one another and to the pipe so as to avoid impeding normal bending of the conduit due to movement of the vessel; and wherein there are at least three of the segments comprising an upper segment, a lower segment, and an intermediate segment located between the upper and lower segments, and wherein the mounting means comprises:

means for rigidly connecting an upper end of the upper segment to the conduit;

means for rigidly connecting a lower end of the lower segment to the conduit;

a plurality of standoff plates located in the segments, each of the plates having a hole for receiving the conduit, at least some of the holes being larger in diameter than an outer diameter of the conduit so as to provide radial gaps; and spacer means between the intermediate segment and the upper and lower segments to provide axial gaps.

8. A riser system for communicating fluids from a subsea well to a surface vessel, comprising in combination:

a subsea wellhead at a sea floor;

a riser connected to the wellhead and extending through an opening in the surface vessel, the riser having at least one string of tubing for flowing the fluids from the well to the surface vessel;

a protective sleeve assembly mounted to the riser where it passes through the opening for protecting the riser due to movement of the vessel; the protective sleeve assembly comprising:

cylindrical upper, intermediate and lower housings;

at least one conduit extending through the opening which has a resistance to bending that is substantially the same as the tubing;

means for rigidly mounting an upper end of the upper housing to the conduit and a lower end of the lower housing to the conduit;

a lower standoff plate mounted to a lower end of the upper housing and having a hole through which the conduit passes, the hole being larger in diameter than an outer diameter of the conduit to provide a radial gap;

upper and lower standoff plates mounted to upper and lower ends, respectively, of the intermediate housing, each of the upper and lower standoff plates of the intermediate housing having a hole through which the conduit passes, the hole of each of the standoff plates of the intermediate conduit being larger in diameter than the outer diameter of the conduit to provide a radial gap;

an upper standoff plate mounted to an upper end of the lower housing and having a hole through which the conduit passes, the hole of the upper standoff plate of the lower housing being larger in diameter than the outer diameter of the conduit to provide a radial gap; and spacer means between the intermediate housing and the upper and lower housings for providing selected axial gaps between the housings to allow articulated movement of the housings relative to one another.

9. The riser system according to claim 8, further comprising:

an intermediate standoff plate located between the upper and lower ends of the intermediate housing which rigidly secures the intermediate housing to the conduit.

10. A method of protecting a riser which extends from a subsea wellhead housing to a surface vessel, comprising:

mounting a sleeve assembly of segments connected to each other for articulated movement around the riser, allowing unrestricted bending of the riser up to a maximum bend radius by allowing the segments to move relative to one another in articulation; and at the maximum bend radius, preventing further articulating movement of the segments to augment the riser's resistance to bending.

11. A method of protecting a riser which extends from a subsea wellhead housing to a surface vessel, comprising:

mounting a sleeve assembly around the riser to protect the riser from contact with other structures during bending, and providing the sleeve assembly with a lesser resistance to bending than the riser so as to not restrict bending of the riser, allowing completely free articulation of the sleeve assembly up to the maximum bend radius selected for the riser; and wherein the riser has at least one string of tubing and the step of mounting the sleeve assembly comprises:

providing a plurality of separate segments, each having a cylindrical exterior and at least one transverse standoff plate having a hole therethrough;

extending a conduit through the holes in the standoff plates and securing the conduit to the tubing;

providing axial gaps between the segments for articulated movement relative to one another; and providing radial gaps between the conduit and the holes in the standoff plates of the segments to allow the conduit to bend a selected amount without being impeded by the segments.

12. The method according to claim 11 wherein the conduit has substantially the same resistance to being as the tubing.

* * * * *